US007926128B2

(12) United States Patent
Mammi

(10) Patent No.: US 7,926,128 B2
(45) Date of Patent: Apr. 19, 2011

(54) AUXILIARY EQUIPMENT SYSTEM FOR BATHROOM ACCESSIBILITY

(76) Inventor: Luca Mammi, La Spezia (IT)

( * ) Notice: Subject to any disclaimer, the term of this patent is extended or adjusted under 35 U.S.C. 154(b) by 1014 days.

(21) Appl. No.: 11/667,403

(22) PCT Filed: Nov. 9, 2005

(86) PCT No.: PCT/IB2005/003413

§ 371 (c)(1),
(2), (4) Date: May 9, 2007

(87) PCT Pub. No.: WO2006/051412

PCT Pub. Date: May 18, 2006

(65) Prior Publication Data

US 2008/0251673 A1 Oct. 16, 2008

(30) Foreign Application Priority Data

Nov. 10, 2004 (IT) ..... MI2004A2156

(51) Int. Cl.
*A47K 4/00* (2006.01)

(52) U.S. Cl. ..... 4/663; 248/244

(58) Field of Classification Search ..... 4/663, 643, 4/645, 559; 248/419, 243, 244; 211/119.009, 211/119.011

See application file for complete search history.

(56) References Cited

U.S. PATENT DOCUMENTS

| | | | | |
|---|---|---|---|---|
| 5,069,350 | A * | 12/1991 | Wolff et al. | 211/106.01 |
| 5,337,525 | A * | 8/1994 | Zaccai et al. | 52/35 |
| 6,820,290 | B1 * | 11/2004 | Mullick et al. | 4/663 |
| 2009/0074334 | A1 * | 3/2009 | Juan | 384/19 |

FOREIGN PATENT DOCUMENTS

| | | | |
|---|---|---|---|
| DE | 297 02 094 | U1 | 3/1997 |
| FR | 2 536 830 | A | 6/1984 |

OTHER PUBLICATIONS

International Search Report, Jan. 25, 2006.

* cited by examiner

*Primary Examiner* — Gwendolyn Baxter
(74) *Attorney, Agent, or Firm* — Hedman & Costigan P.C.; James V. Costigan

(57) ABSTRACT

The present invention relates to a system for bathroom accessibility, which is based on a device having at least one horizontal guide fixable to a wall, at least one hooking element, which slides with respect to the guide, and at least one supporting element for equipment that engages the hooking element. The hooking element includes a regulation device for selectively varying the height of at least one supporting element for bathroom equipment.

12 Claims, 4 Drawing Sheets

AUXILIARY EQUIPMENT SYSTEM FOR BATHROOM ACCESSIBILITY

The present invention relates to a wall hooking system of equipment for bathroom accessibility and in particular an adjustable wall hooking system of equipment for bathroom accessibility.

The accessibility and safety of bathroom utilities for people suffering from motor disablements does not generally only depend on the maneuvering space available, but also on the presence of items of equipment which allow use of the single bathroom utilities.

Among these the following can be mentioned, for example:

the handle next to the water closet which provides a supporting point and facilitates movements for sitting down and standing up from the lavatory bowl;

a handle, situated in the shower or bathtub to guarantee an anchoring point which favors equilibrium in more complex cleaning operations, such as those of the lower limbs.

In the case of people suffering from serious motor limitations and problems of fatigue, the use of a chair is also envisaged; for those using a wheelchair and who are therefore not able to stand up, the presence of the seat is restricting for using these sanitary utilities.

These items of equipment greatly influence the capacity of users with motor difficulties from using sanitary fixtures autonomously and safely.

The aspect which most significantly determines the effectiveness of this auxiliary equipment is that relating to their positioning. A piece of equipment of this kind erroneously positioned with respect to the necessity and residual capacity of the user becomes useless or can only be adopted with great effort, creating an increase in the danger of accidents.

A correct positioning of this auxiliary equipment can be obtained by designing the rooms in relation to the functional capacities, measurements and means of movement of the person for whom they are destined.

In other words, a correct planning of bathroom facilities and positioning of the relative auxiliary equipment is at present only possible in private households where the number of possible users is extremely limited.

In public bathroom facilities, for which accessibility to a large number of people is required, the configuration and positioning of the auxiliary equipment should be capable of satisfying the demands of the greatest number of potential users.

This condition obviously becomes more difficult when the public bathroom has to guarantee complex sanitary performances, similar to those of a household bathroom, as in the case of hotels, clinics, rest-homes, etc.

Furthermore, the infinite series of auxiliary equipment with which public sanitary utilities are normally provided, make these environments quite uncomfortable.

For this reason their use is not particularly acceptable either to disabled people who, however, in the absence of alternatives are compelled to use them, or for non-disabled people who avoid adopting them.

In view of what is specified above, the necessity is evident of availing of a system of auxiliary equipment which allows a personalization to be obtained each time, both easily and rapidly, of the configuration of equipment on the basis of the necessity of the user of the room.

An objective therefore of the present invention is to solve the problems of the known art by providing a system of auxiliary equipment for bathroom accessibility which is highly flexible.

A further objective of the present invention is to provide a system of auxiliary equipment for bathroom accessibility which allows the various items of equipment to be installed or removed according to necessity.

Another objective of the present invention is to provide a system of auxiliary equipment for bathroom accessibility which allows the positioning of each single piece of equipment in the position and at the most suitable height for the capacity and measurements of those using it.

And finally, an additional objective of the present invention is to provide a wall hooking system of auxiliary equipment for bathroom accessibility which does not degrade the environment in which it is positioned.

These and other objectives are achieved by the system of auxiliary equipment for bathroom accessibility according to the present invention which has the characteristics of the enclosed claim 1.

Further characteristics of the invention are specified in the subsequent claims.

Substantially, a system of equipment for bathroom accessibility according to the present invention and of the type having at least one horizontal guide, fixable to the wall, at least one hooking element, which slides with respect to the guide, and at least one supporting element for equipment, engaged with the hooking element is characterized in that the hooking means comprises regulation devices for selectively varying the height of each supporting element for the equipment.

Further characteristics and advantages of the present invention will appear more evident from the present description provided for illustrative and non-limiting purposes, with reference to the enclosed drawings, in which.

Figure 1:
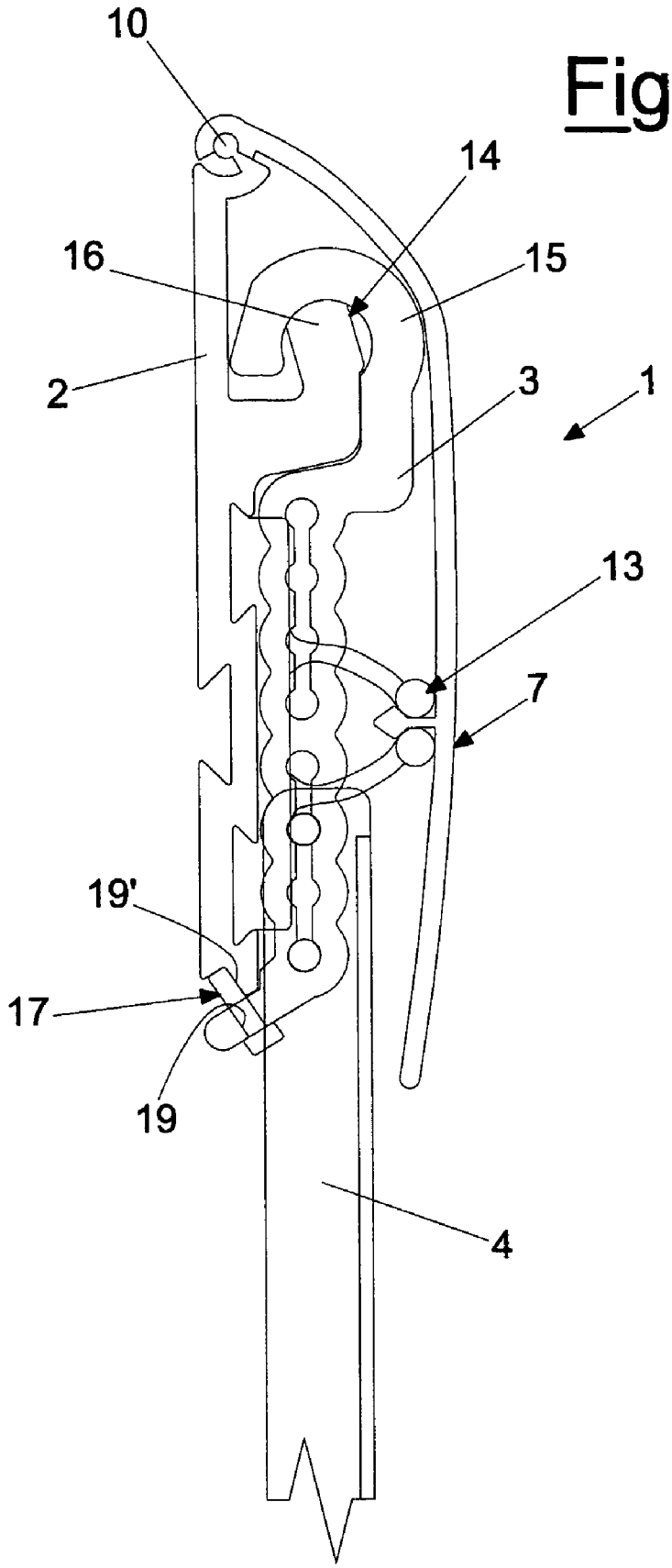
FIG. 1 shows a raised sectional side view of a first embodiment of the system of auxiliary equipment for bathroom accessibility according to the present invention.

With reference to FIGS. 1-4, these show a system of auxiliary equipment for bathroom accessibility according to the present invention.

The system, according to the present invention, indicated as a whole with the numerical reference 1, is equipped with at least one horizontal guide 2, fixable to the wall, at least one hooking element 3, which slides horizontally with respect to the guide 2, and at least one supporting element 4 for equipment, engaged with the hooking element 3.

According to the present invention, the hooking means 3 advantageously comprises regulation means 5 suitable for selectively varying, i.e. according to the necessity of the user, the height of at least one supporting element 4 for auxiliary equipment.

For this purpose, the regulation means 5 are represented by a series of seats 20 in which regulation pins, not shown, are engaged, suitable for hooking the auxiliary equipment at the desired height.

In detail, the regulation pins can not only be engaged with the seats 20, but also with at least one corresponding seat 21 present on the upper end of the supporting element 4.

By selecting the most suitable of the seats 20, for engagement with the relative regulation pin and with the corresponding seat 21, it is possible to selectively vary the height of the supporting element 4 and consequently the height of the auxiliary equipment, with respect to the floor.

Alternatively, the regulation pins can be produced integral with the supporting element 4, without being excluded from the protection scope of the present invention.

Figure 2:
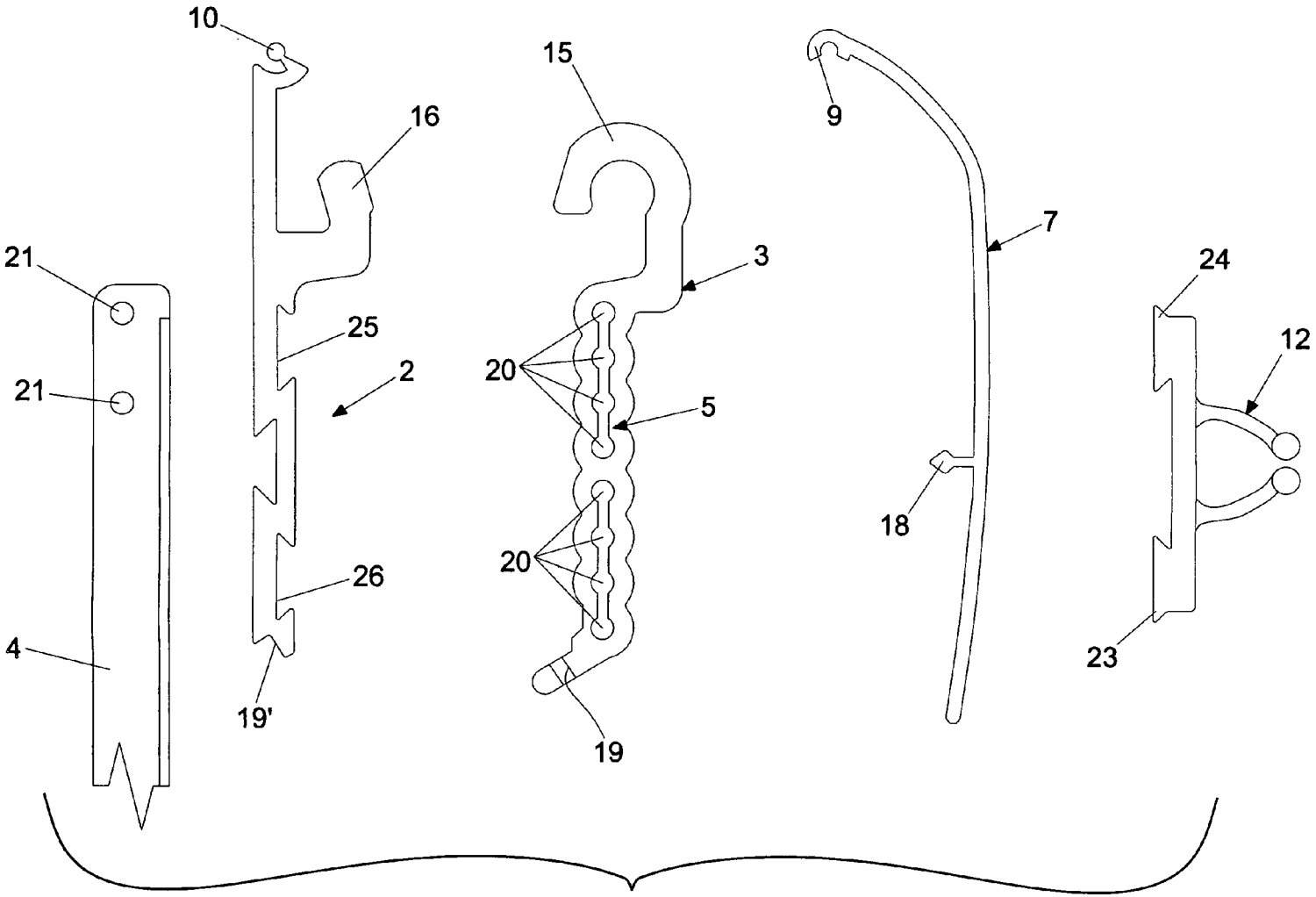
FIG. 2 shows an exploded view of the components of the embodiment of the system of auxiliary equipment for bathroom accessibility shown in FIG. 1.
Figure 3:
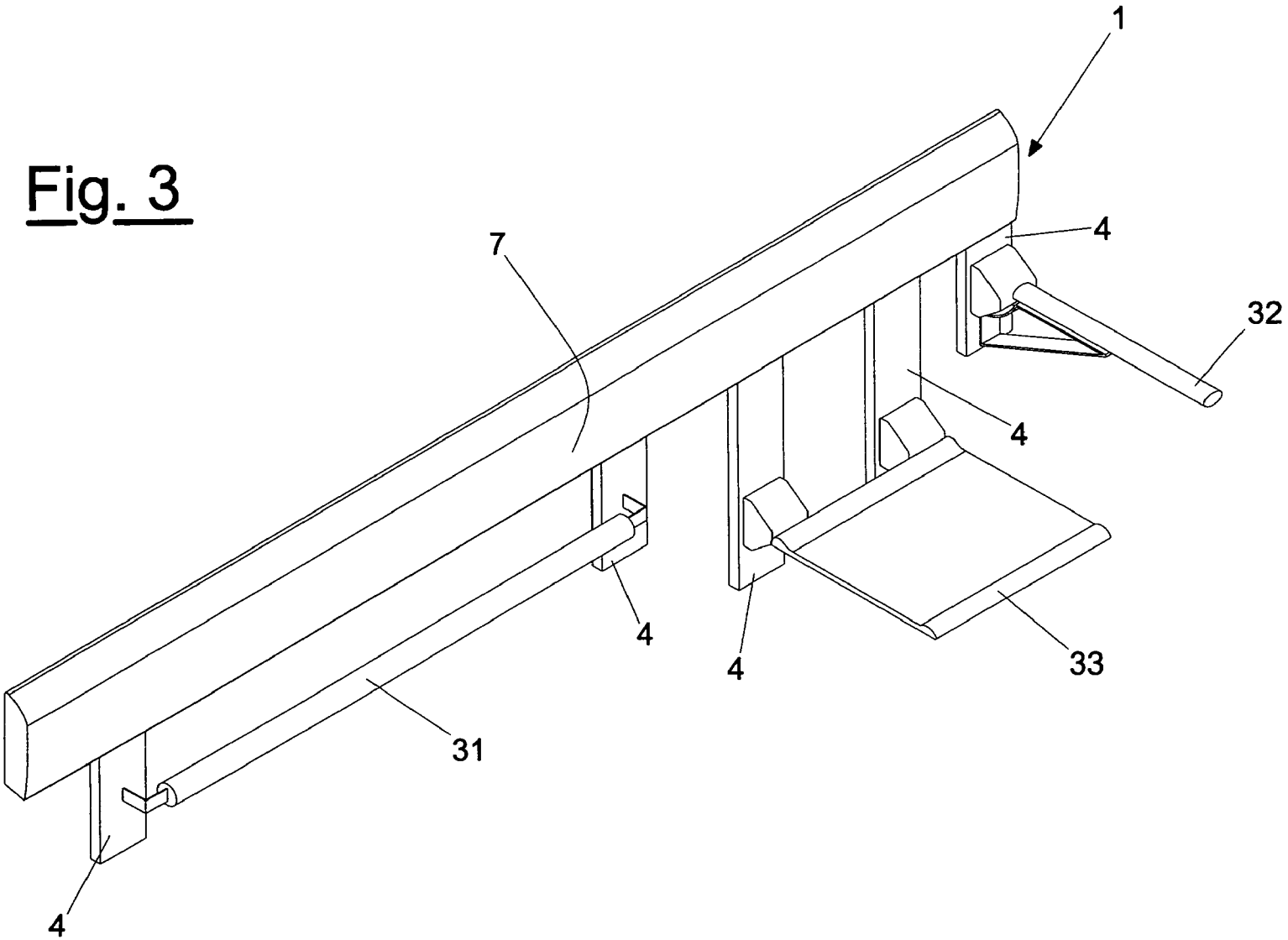
FIG. 3 shows a perspective view of an example of the system of auxiliary equipment for bathroom accessibility according to the present invention fixed to the wall.

The supporting element 4, as better illustrated in FIGS. 2 and 3, is represented by a rod equipped, in correspondence with its upper end, with the above seats 21 and in correspondence with its lower end, but at an appropriate distance therefrom, with hooking means, of the known type, to the auxiliary equipment.

Each item of auxiliary equipment can have more than one supporting element 4, according to necessity.

For example, it can be seen in FIG. 3 how the handle 31 for assisting walking and the seat 33 have two supporting elements 4 situated in correspondence with their ends, whereas the handle 32 has only one supporting element 4.

Figure 4:
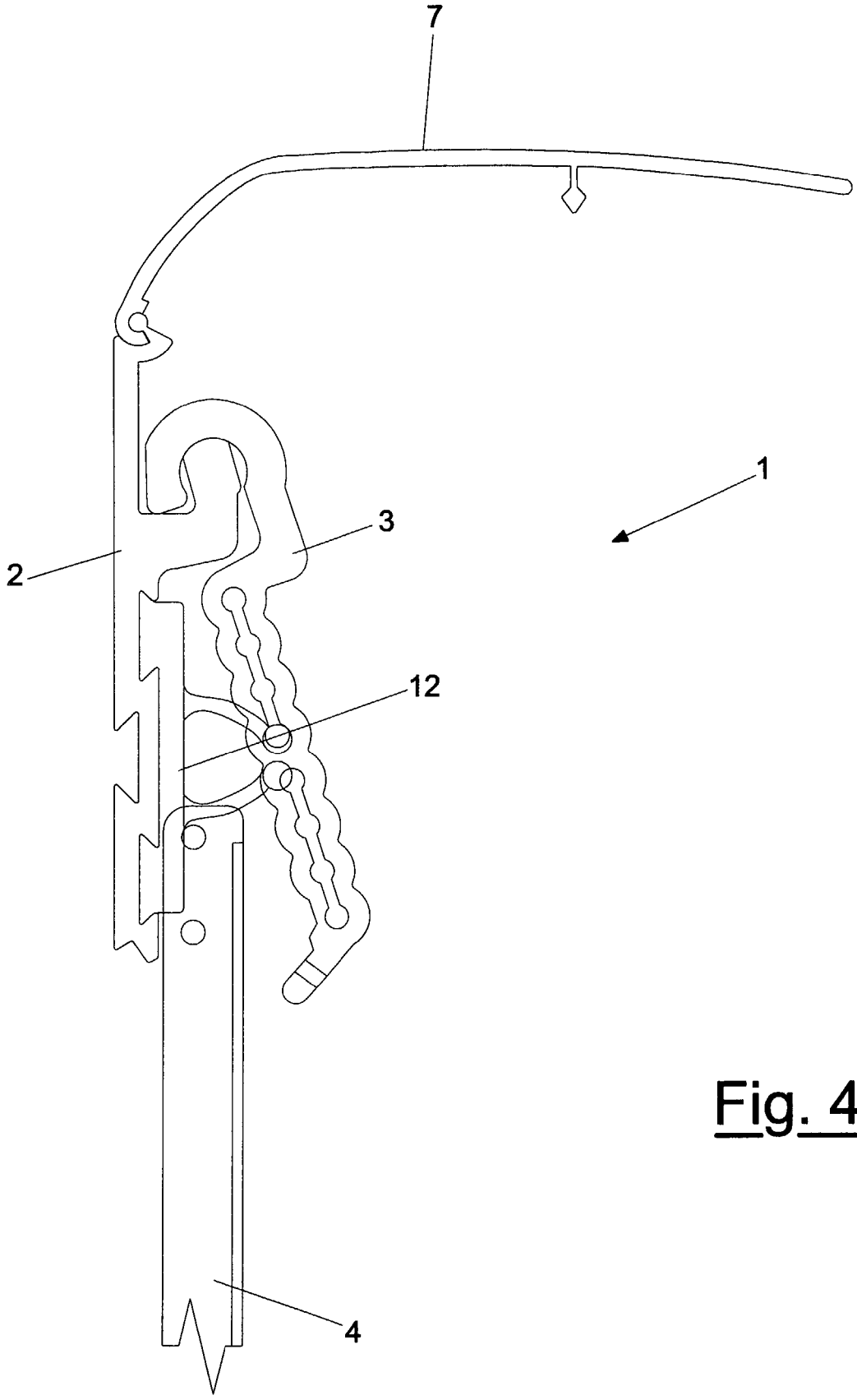
FIG. 4 is a raised side view of the embodiment of the system of auxiliary equipment for bathroom accessibility according to the present invention, with the covering element in an overturned position.

The hooking element 3, according to another advantageous aspect of the present invention, comprises hinging means 14 for allowing the rotation, as shown in FIG. 4, of the hooking element 3 with respect to the guide 2.

The hinging means 14 are positioned in correspondence with the upper end of the hooking guide 3 and the guide 2 and respectively consist of a hooking portion 15 of the hooking element 3 and a corresponding hooking portion 16 of the guide 2. The hooking portion 15 of the hooking element 3 can be rotationally engaged with the corresponding hooking portion 16 of the guide 2 to allow the rotation of the hooking element 3 with respect to the guide 2.

The particular conformation of the hinging means 14 also allows the hooking element 3 to be removed from its engagement with the guide 2.

Blocking means 17 are also envisaged for blocking the hooking element 3 with respect to the guide 2 and also avoiding horizontal movements, i.e. parallel to the field.

The blocking means 17 are represented by at least one threaded screw 18 which can be engaged in at least one hole 19 present on the hooking element 3 and in at least one corresponding hole 19' present on the guide 2.

Alternatively, the blocking means 17 could be represented by any mechanical element, such as a stop, a clip or a pin suitable for the purpose.

It should also be noted that, in order to enhance the appearance of the system according to the present invention, there is at least one covering element 7 suitable for hiding at least the guide 2 and hooking element 3 from sight.

The covering element 7 has rotational engagement means 9 10 with the guide 2.

The rotational engagement means 9, 10 allow the rotation of the covering element 7 from a closed position, shown in FIG. 1, in which the element 7 hides the guide 2 and the hooking element 3 from sight, to an overturned position, shown in FIG. 4, which allows their accessibility.

In detail, the rotational engagement means comprise a pin portion 10, envisaged in correspondence with the upper end of the guide 2, and an enfolding portion 9, envisaged in correspondence with the upper end of the covering element 7.

The pin portion 10 has a clip-release engagement with the enfolding portion 9 to allow the rotation of the covering element 7 with respect to the guide 2.

The clip-release of the pin portion 10 with the enfolding portion 9, also allows the covering element 7 to be simply and rapidly removed from the guide 2.

According to the present invention, closing means 13 for the covering element 7, suitable for blocking the covering element 7 in a closed position, are also advantageously envisaged.

For this purpose, the closing means 13 comprise at least one clip element 12, which slides in engagement with the guide 2, and at least one pin element 18 internally protruding from the covering element 7.

The pin element 18 is dimensioned and shaped for being blocked and is releasable inside the clip element 12.

As mentioned above, the clip element 12 slides horizontally in engagement with at least one groove, two 25, 26 in the embodiment shown in the figure, of the guiding element 2.

For this purpose, the clip element 12 has two protruding portions 23, 24 shaped so as slide horizontally in the two corresponding parallel grooves 25, 26 of the guide 2.

The system 1 according to the present invention also comprises wall fixing means of the known type for the guide 2.

The characteristics of the system of auxiliary equipment for bathroom accessibility, object of the present invention, are evident from the above description, as are also the relative advantages, among which the following can be mentioned:

the possibility of installing and removing the various pieces of equipment according to necessity;

the extreme facility of equipping or super-equipping the bathroom for the various demands of the users suffering from disabilities and, at the same time, offering the possibility of removing all the special items of equipment.

Once the equipment has been removed, the accessible room (with sanitary facilities in series) will only differ from others in the larger area and can be using without any resistance on the part of ordinary clients when people suffering from disablements are not present on the premises.

the possibility of fixing each single item of equipment in the position and at the height most appropriate for the capacities and measurements of the user;

the possibility of reproducing a configuration of equipment based on the parameters supplied by the disabled user.

The present invention is described for illustrative but non-limiting purposes, according to its preferred embodiments, but it is understood that variations and/or modifications can be applied by experts in the field, which are included in the relative protection scope, as defined in the enclosed claims.

The invention claimed is:

1. A system (1) of equipment for bathroom accessibility equipped with at least one horizontal guide (2) fixable to the wall, at least one hooking element (3), which slides horizontally with respect to the guide (2), and at least one supporting element for equipment (4), engaged with said hooking element (3), characterized in that said hooking means (3) comprises regulation means (5) for selectively varying the height of said at least one supporting element (4) for equipment where said regulation means (5) comprise a series of seats (20) which can be engaged with regulation pins and at least one seat (21) is present on said supporting element (4), which can be engaged with at least one regulation pin and with at least one seat of said series of seats (20) for selectively varying the height of said at least one supporting element for equipment (4), with respect to said guide (2).

2. The system (1) of equipment for bathroom accessibility claim 1, characterized in that it comprises hinging means (14) for allowing said hooking means (3) to rotate with respect to said guide (2).

3. The system (1) of equipment for bathroom accessibility according to claim 2, characterized in that said hinging means (14) comprise a hooking portion (15) of said hooking element (3) which can be rotationally engaged on a corresponding hooking portion (16) of said guide (2).

4. The system (1) of equipment for bathroom accessibility according to claim 1 characterized in that it comprises blocking means (17, 19, 19') for blocking said hooking element (3) with respect to said guide (2).

5. The system (1) of equipment for bathroom accessibility according to claim 4, characterized in that said blocking means comprise at least one threaded screw (17) which can be engaged in at least one hole (19) present on said hooking element (3) and in at least one corresponding hole (19') present on said guide (2).

6. The system (1) of equipment for bathroom accessibility according to claim 1 characterized in that it comprises at least a covering element (7) for hiding said guide (2) and said hooking element (3) from sight.

7. The system (1) of equipment for bathroom accessibility according to claim 6, characterized in that it comprises rotational engagement means (9, 10) for allowing the rotation of said covering element (7), with respect to said guide (2) from a closed position, in which said guide (2) and said hooking means (3) are hidden from sight, to an overturned position which allows accessibility to said guide (2) and to said hooking means (3).

8. The system (1) of equipment for bathroom accessibility according to claim 7, characterized in that said rotational engagement means (9, 10) comprise a portion (10) with a pin element protruding from said guide (2) and a portion (9).

9. The system (1) of equipment for bathroom accessibility according to claim 1, characterized in that it comprises closing means (13) for blocking said covering element (7) in a closed position.

10. The system (1) of equipment for bathroom accessibility according to claim 9, characterized in that said closing means (13) comprise at least one clip element (12), which slides in engagement with said guide (2), and at least one pin (18) internally protruding from said covering element (7) suitable for being clip-release blocked and released from said clip element (12).

11. The system (1) equipment for bathroom accessibility according to claim 10, characterized in that said clip element (12) slides horizontally in engagement with at least one groove (21, 22) of said guiding element (2).

12. The system (1) of equipment for bathroom accessibility according to claim 1 characterized in that it comprises wall fixing means of said guide (2).

* * * * *